US009657519B2

(12) United States Patent
Mehta et al.

(10) Patent No.: US 9,657,519 B2
(45) Date of Patent: May 23, 2017

(54) NUTATING FLUID-MECHANICAL ENERGY CONVERTER TO POWER WELLBORE DRILLING

(71) Applicant: Halliburton Energy Services, Inc., Houston, TX (US)

(72) Inventors: Krunal Kanubhai Mehta, Gujarat (IN); Ragi Lohidakshan Poyyara, Maharashtra (IN); Amitkumar Suresh Rawool, Maharashtra (IN)

(73) Assignee: Halliburton Energy Services, Inc., Houston, TX (US)

( * ) Notice: Subject to any disclaimer, the term of this patent is extended or adjusted under 35 U.S.C. 154(b) by 149 days.

(21) Appl. No.: 14/410,416

(22) PCT Filed: Jan. 30, 2014

(86) PCT No.: PCT/US2014/013926
§ 371 (c)(1),
(2) Date: Dec. 22, 2014

(87) PCT Pub. No.: WO2015/116116
PCT Pub. Date: Aug. 6, 2015

(65) Prior Publication Data
US 2016/0230462 A1 Aug. 11, 2016

(51) Int. Cl.
*E21B 4/00* (2006.01)
*E21B 4/02* (2006.01)
(Continued)

(52) U.S. Cl.
CPC ..... *E21B 4/006* (2013.01); *E21B 3/00* (2013.01); *E21B 4/02* (2013.01); *F03B 13/02* (2013.01)

(58) Field of Classification Search
CPC ... E21B 4/02; E21B 4/06; E21B 4/006; E21B 3/00; F03B 13/02
See application file for complete search history.

(56) References Cited

U.S. PATENT DOCUMENTS 465,050 A 12/1891 Rand et al.
493,844 A 3/1893 Schroder
(Continued)

FOREIGN PATENT DOCUMENTS

CN 201902282 7/2011
CN 202091094 12/2011
(Continued)

OTHER PUBLICATIONS

Meitner, "The Nutating Engine—Prototype Engine Progress Report and Test Results", NASA/TM-2006-214342, Oct. 2006, 11 pages.
(Continued)

*Primary Examiner* — Nicole Coy
(74) *Attorney, Agent, or Firm* — Alan Bryson; Parker Justiss, P.C.

(57) ABSTRACT

In one example, a nutating fluid-mechanical energy converter to power wellbore drilling includes a fluid-mechanical device and a rotation transfer device, each positionable in a wellbore drill string. The fluid-mechanical device includes a stator including an outer cylinder having a longitudinal passage and a longitudinal guide positioned in the longitudinal passage, which, with the stator, defines an annulus. A rotor cylinder is positioned in the annulus. The rotor cylinder includes a sidewall with a guide opening to receive the longitudinal guide. The rotor cylinder rotates within the stator along the longitudinal guide in response to the wellbore drilling fluid flow through the annulus. The rotation transfer device transfers at least a portion of a rotation of the rotor cylinder to a wellbore drill bit.

20 Claims, 10 Drawing Sheets

(51) Int. Cl.
*E21B 3/00* (2006.01)
*F03B 13/02* (2006.01)

(56) References Cited

U.S. PATENT DOCUMENTS

| | | | |
|---|---|---|---|
| 547,180 | A | 10/1895 | Nash |
| 1,026,992 | A | 5/1912 | Monard |
| 1,229,676 | A | 6/1917 | Tice |
| 1,459,637 | A | 6/1923 | Jules |
| 1,892,217 | A | 12/1932 | Moineau |
| 1,906,142 | A | 4/1933 | John |
| 1,967,957 | A | 7/1934 | Lucas |
| 1,973,670 | A | 9/1934 | Frank |
| 2,804,827 | A | 9/1957 | Emil |
| 3,583,502 | A | 6/1971 | Henderson |
| 4,187,061 | A | 2/1980 | Jurgens |
| 4,773,834 | A | 9/1988 | Saruwatari |
| 5,011,386 | A | 4/1991 | Guttinger |
| 5,833,444 | A | 11/1998 | Harris et al. |
| 5,833,541 | A | 11/1998 | Turner et al. |
| 6,227,797 | B1 | 5/2001 | Watterson et al. |
| 6,520,271 | B1 | 2/2003 | Martini |
| 7,172,039 | B2 | 2/2007 | Teale et al. |
| 7,563,080 | B2 | 7/2009 | Masuda |
| 7,878,778 | B2 | 2/2011 | Shimizu et al. |
| 8,206,140 | B2 | 6/2012 | Ooi et al. |
| 2006/0073051 | A1 | 4/2006 | Hwang et al. |
| 2007/0036666 | A1 | 2/2007 | Masuda |
| 2009/0139769 | A1 | 6/2009 | Traylor |
| 2009/0285054 | A1 | 11/2009 | Song |
| 2010/0038142 | A1 | 2/2010 | Snyder et al. |
| 2010/0233008 | A1 | 9/2010 | Sotojima et al. |
| 2011/0031020 | A1 | 2/2011 | Cote |
| 2011/0150685 | A1 | 6/2011 | Wilbourn et al. |
| 2012/0228875 | A1 | 9/2012 | Hardin, Jr. et al. |
| 2013/0136639 | A1 | 5/2013 | Simpson |
| 2014/0023540 | A1 | 1/2014 | Heidecker et al. |

FOREIGN PATENT DOCUMENTS

| | | |
|---|---|---|
| EP | 2199599 | 6/2010 |
| WO | WO 2004/113664 | 12/2004 |
| WO | WO 2007/000122 | 1/2007 |
| WO | WO 2011/022835 | 3/2011 |

OTHER PUBLICATIONS

International Search Report and Written Opinion issued in International Searching Authority issued in International Application No. PCT/US2014/013926 on Oct. 31, 2014; 10 pages.

International Search Report and Written Opinion of the International Searching Authority issued in International Application No. PCT/US2013/071739 on Aug. 7, 2014; 11 pages.

Halliburton, "Annular Flow Area," Second Edition, H06264, May 2012, 68 pages.

Halliburton, "Downhole Equipment Technical Specification Information," H06039, May 2012, 20 pages.

Halliburton, "SperryDrill®," H07065, Sep. 2011, 65 pages.

NUTATING FLUID-MECHANICAL ENERGY CONVERTER TO POWER WELLBORE DRILLING

CLAIM OF PRIORITY

This application is a U.S. National Stage of International Application No. PCT/US2014/013926, filed Jan. 30, 2014.

TECHNICAL FIELD

This disclosure relates to supplying power for wellbore drilling.

BACKGROUND

In wellbore drilling, a drill bit is attached to a drill string, lowered into a well, and rotated in contact with a subterranean zone (e.g., a formation, a portion of a formation, or multiple formations). The rotation of the drill bit breaks and fractures the subterranean zone forming a wellbore. A drilling fluid (also known as drilling mud) is circulated down the drill string and through nozzles provided in the drill bit to the bottom of the wellbore, and then upward toward the surface through an annulus formed between the drill string and the wall of the wellbore. The drilling fluid serves many purposes including cooling the drill bit, supplying hydrostatic pressure upon the formation penetrated by the wellbore to prevent fluids from flowing into the wellbore, reducing torque and drag between the drill string and the wellbore, carrying the formation cuttings, i.e., the portions of the formation that are fractured by the rotating drill bit, to the surface, and other purposes.

A high pressure pump (sometimes known as a mud pump) powers the circulation of the drilling fluid through the wellbore drilling system under high pressure. In some situations, the mud pump can be a positive displacement pump (PDM) having an expanding cavity on the suction side and a decreasing cavity on the discharge side. For example, a positive displacement mud pump can include a lobe and a progressive cavity.

DESCRIPTION OF DRAWINGS

Like reference symbols in the various drawings indicate like elements.

DETAILED DESCRIPTION

This disclosure relates to a nutating fluid-mechanical energy converter to power wellbore drilling. As described below, a wellbore drilling system includes a fluid-mechanical device implemented to extract energy from a fluid flow and to convert the extracted energy into a nutating motion. The wellbore drilling system also includes a rotation transfer device to transform the nutating motion of the fluid-mechanical device into rotation. At least a portion of the rotation is transferred to the drill bit to drill the wellbore in the subterranean zone.

In some implementations, the wellbore drilling system can be implemented as the power section of mud motor. By doing so, the conventional power section of positive displacement motors (PDMs), which work on the basis of reverse Monieu principle, can be augmented or replaced. The construction of the power section described here can be void of lobes and consequently be simple and more economic relative to the conventional power section. The power section described here may not stall or may stall less than the conventional power section of PDMs. The conventional power section, e.g., the elastomer, can be damaged, e.g., by chunking of the stator when implemented with hostile mud, e.g., mud containing high benzene. Such damage can be decreased (e.g., minimized or eliminated) by implementing the power section described here. The power section can also be implemented to achieve higher torque relative to the conventional power section. In some situations, the elastomers can be replaced with specialized coatings to decrease (e.g., minimize or eliminate) chunking. In addition, the elastomers can be of even thickness like that of an ERT in conventional mud motor.

Figure 1A:
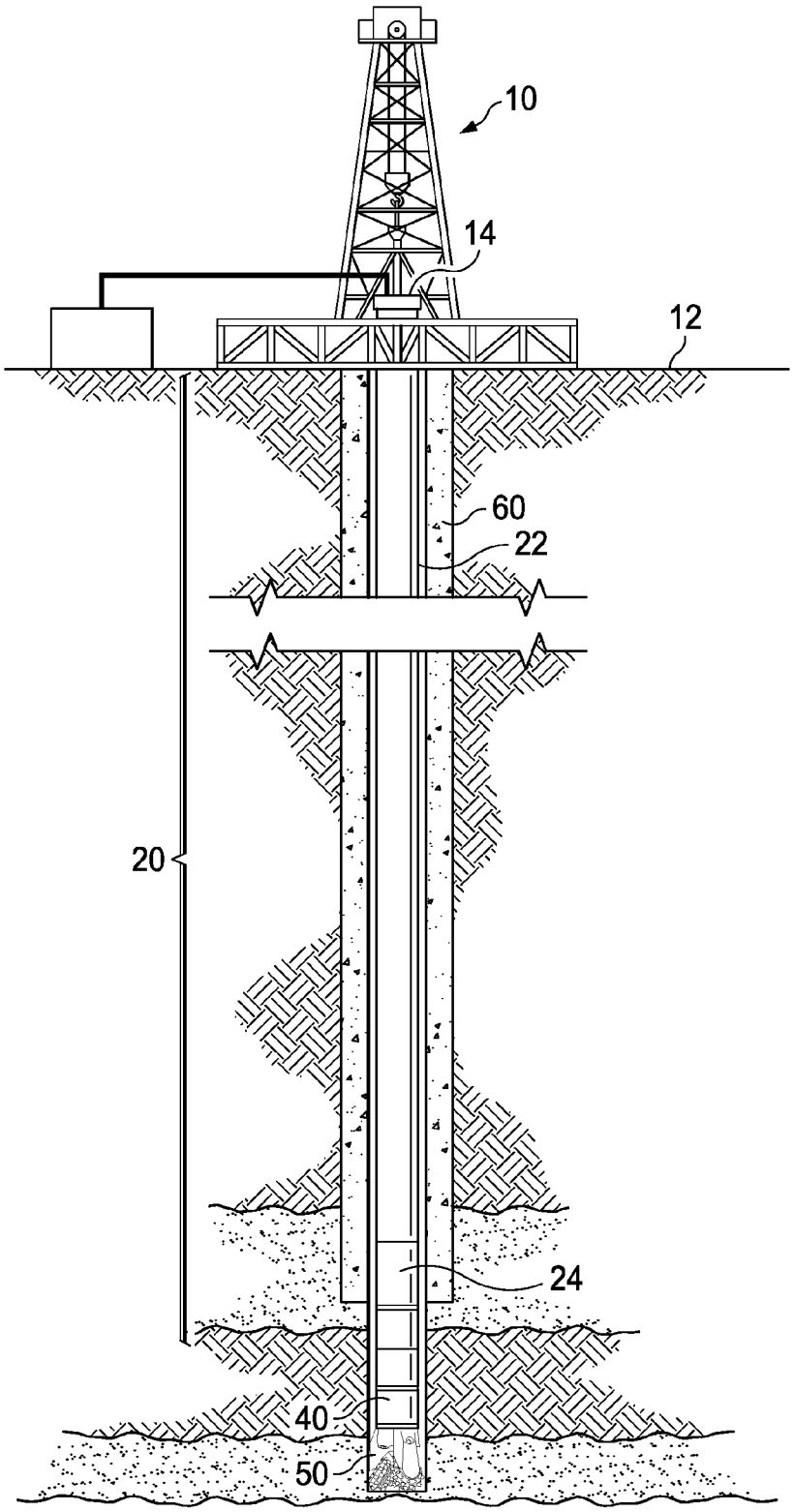
FIGS. 1A-1C are schematic diagrams of an example wellbore drilling system implementing an example power section.

FIG. 1A is a schematic diagram of an example wellbore drilling system implementing an example power section. A drilling rig 10 located at or above the surface 12 rotates a drill string 20 disposed in the wellbore below the surface. The drill string typically includes drill pipe 22 and drill collars 24 that are rotated to transfer torque down the wellbore to a drill bit 50 or other downhole equipment 40 (referred to as the "tool string") attached to a distal end of the drill string 20. The surface equipment 14 on the drilling rig 10 rotates the drill string 20 and the drill bit 50 as the drill bit 50 bores into the subterranean zone to form a wellbore 60. In some implementations, the drill string 20 includes the wellbore drilling system that includes the fluid-mechanical device and the rotation transfer device referenced above and described in detail below.

Figure 1B:
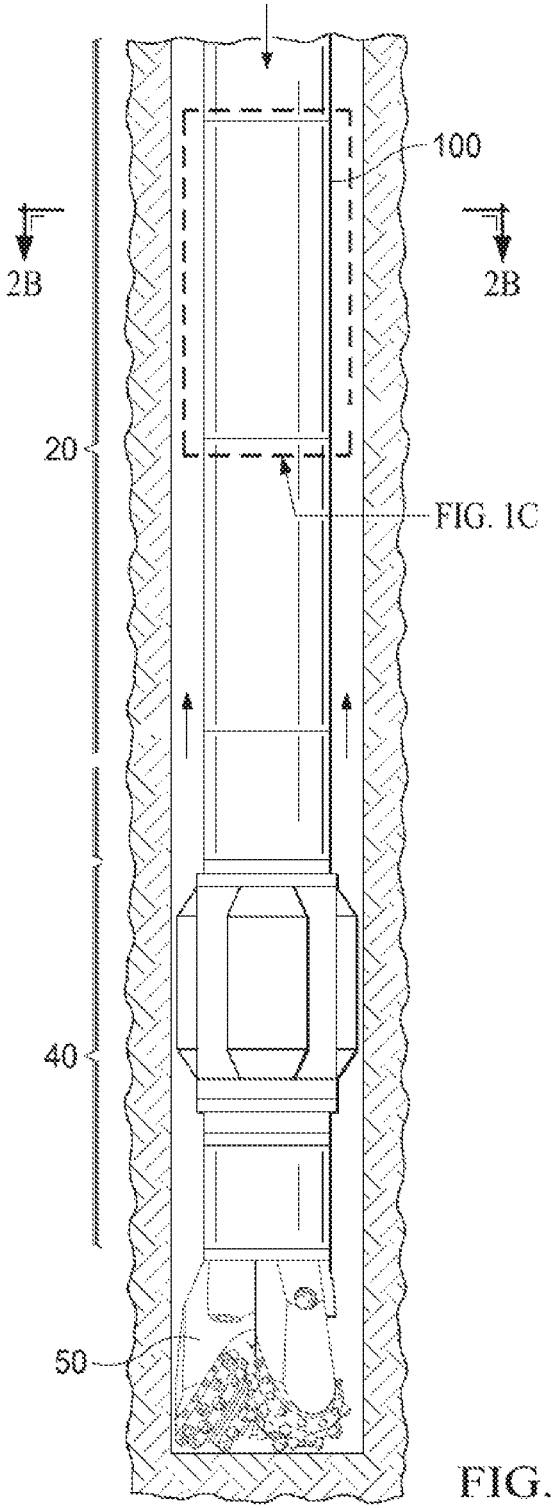

FIG. 1B is a schematic diagram of an example drilling assembly disposed in the wellbore 60. In some implementations, the drilling assembly can be the drill string 20. The distal end of the drilling assembly includes the tool string 40 driven by the wellbore drilling system 100 which includes the fluid-mechanical device and the rotation transfer device positioned in a tubular housing.

Figure 1C:
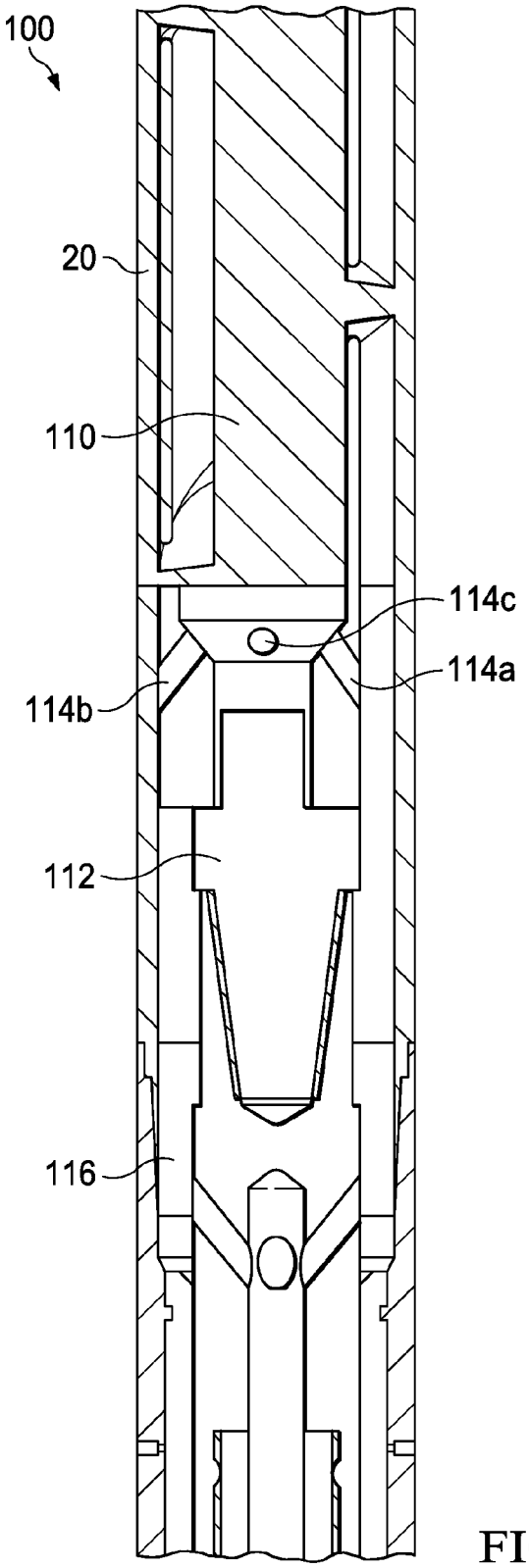

FIG. 1C is a cross-sectional view of a schematic diagram of the wellbore drilling system 100 positioned in the drill string 20. In some implementations, the wellbore drilling system 100 includes the fluid-mechanical device 110 to be positioned in the wellbore drill string 20. As described below, the fluid-mechanical device 110 includes a stator and a rotor cylinder to rotate within the stator in response to wellbore drilling fluid flow through the stator. The wellbore drilling system 100 further includes a rotation transfer device 112 to be positioned in the wellbore drill string 120 and connected to the fluid-mechanical device 110. The rotation transfer device 112 can transfer at least a portion of a rotation of the rotor cylinder to the wellbore drill bit 50.

Figure 2A:
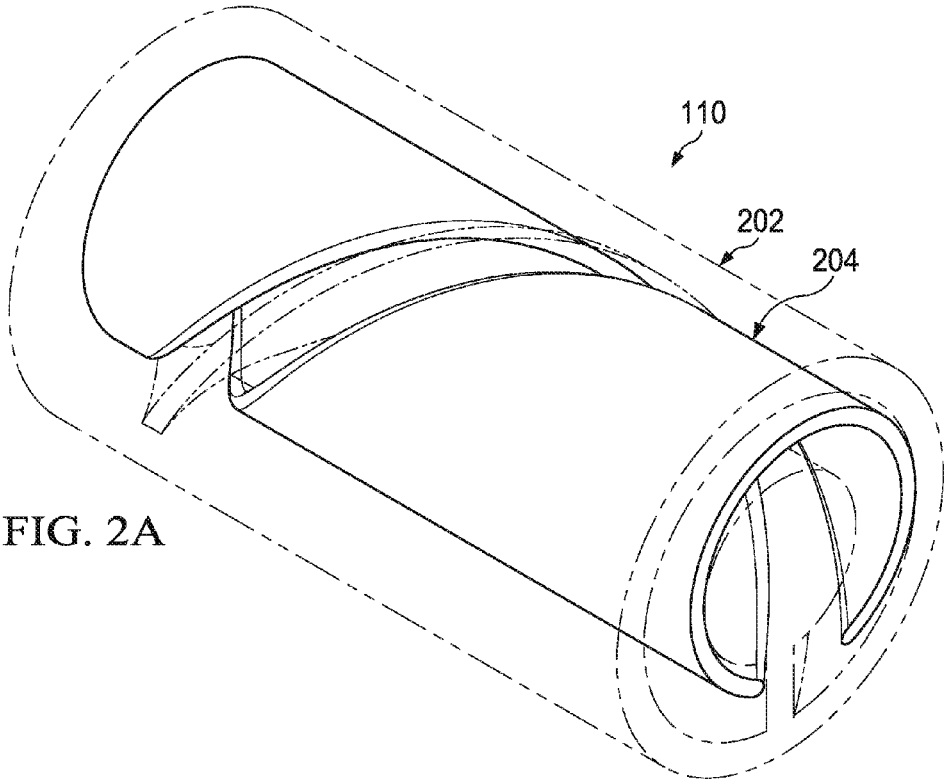
FIG. 2A is a perspective view of an assembled example nutating fluid-mechanical energy converter included in the power section of FIG. 1C.
Figure 2B:
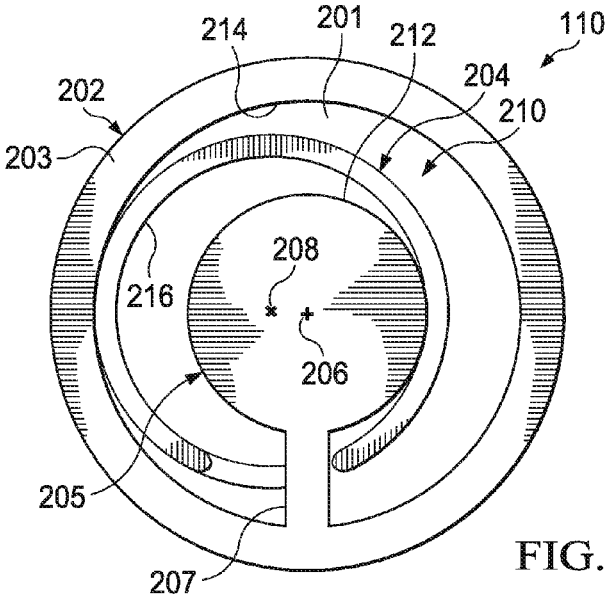
FIG. 2B is a cross-sectional view of the energy converter of FIG. 2A.

FIG. 2A is a perspective view of an assembled example fluid-mechanical device 110 included in the wellbore drilling system 100. The device 110 includes a stator 202 and a rotor having a rotor cylinder 204. FIG. 2B is a cross-sectional view of the device 110 of FIG. 2A. As shown in FIG. 2B, the stator 202 includes a hollow outer cylinder 203 that has a longitudinal passage 201. The stator 202 also includes an inner guide cylinder 205 positioned inside at least a portion of the outer cylinder 203, e.g., inside the longitudinal passage 201, to define an annulus 210 through which fluid (e.g., water, drilling mud, or any other fluid) can flow. The inner guide cylinder 205 can be a solid cylinder or be at least partially hollow. For example, the inner guide cylinder 205 can be a hollow cylinder with closed ends. In some implementations, the outer cylinder 203 and the inner guide cylinder 205 can be substantially concentric. For example, the axes of the outer cylinder 203 and the inner guide cylinder 205 can be co-linear (i.e., coaxial).

Figure 3:
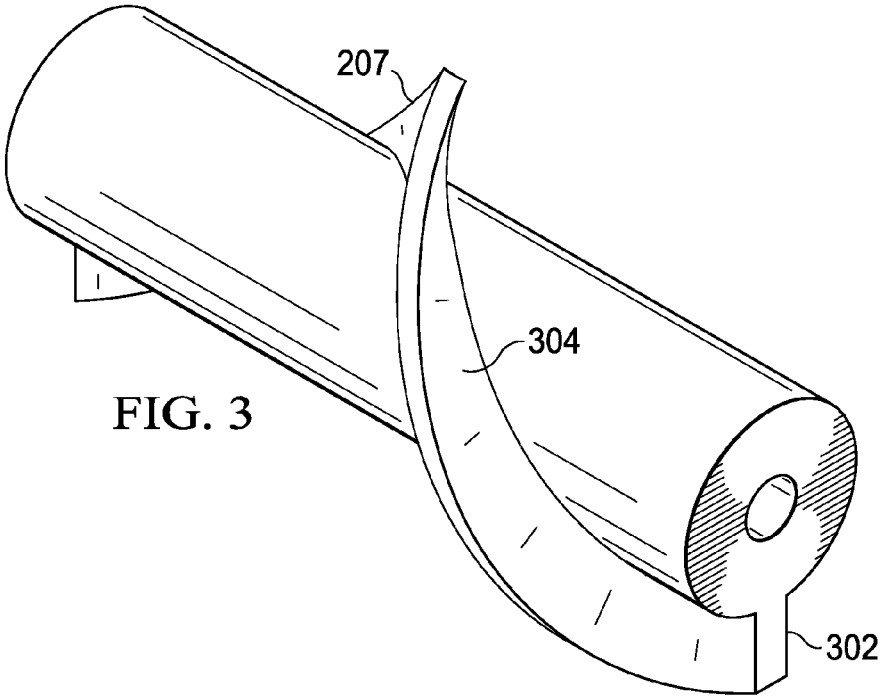
FIG. 3 illustrates an example of a longitudinal guide of the energy converter of FIG. 2A.

FIG. 3 is a perspective view of an example of a longitudinal guide 207 of the fluid-mechanical device 110. The stator 202 includes the longitudinal guide 207 that is positioned inside at least a portion of the outer cylinder 203, e.g., in the annulus 210. The longitudinal guide 207 is attached to a portion of an outer surface 212 of the inner guide cylinder 205 and extends outwardly toward an inner surface 214 of the outer cylinder 203. In some implementations, the longitudinal guide 207 comprises a rectangular cross-section 302 (FIG. 3) and a rectangular side surface 304 (FIG. 3) that extends outwardly toward the inner surface 214 of the outer cylinder 203 from the outer surface 212 of the inner guide cylinder 205. As shown in FIG. 3, the longitudinal guide 207 can be a helical guide, i.e., wound helically around the outer surface 212 of the inner guide cylinder 205. The helical guide can span at least a portion of the length of the inner guide cylinder 203.

Figure 4:
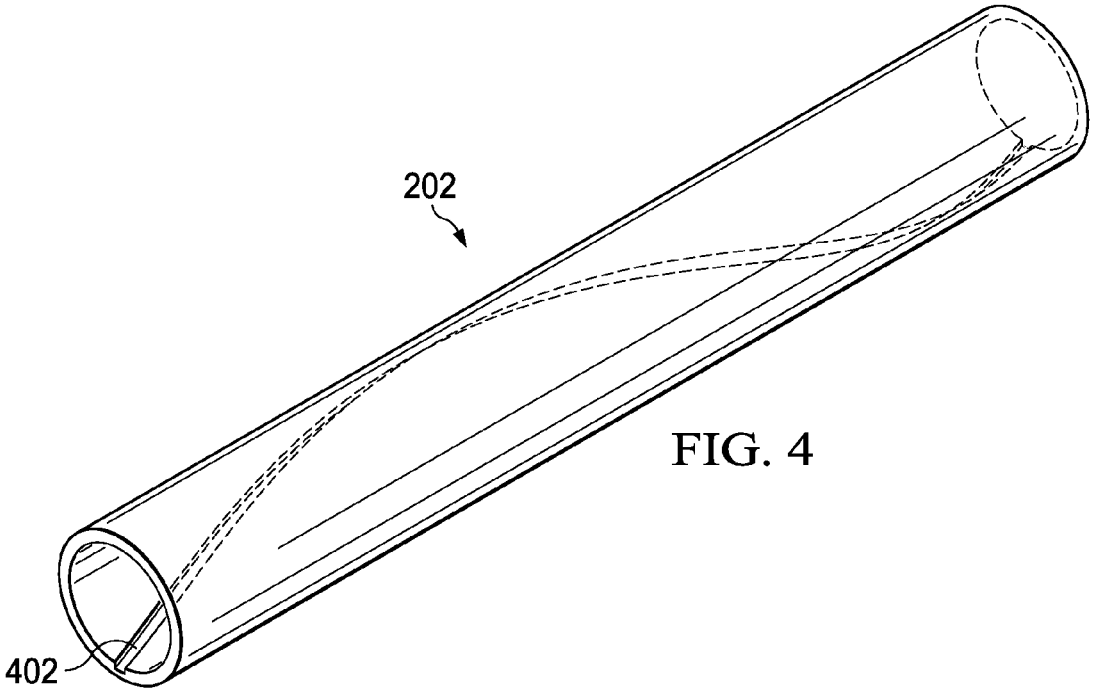
FIG. 4 illustrates an example of a groove to receive the longitudinal guide of FIG. 3.

FIG. 4 is a perspective view of an example of a groove 402 to receive the longitudinal guide 207. In some implementations, the longitudinal guide 207 can connect the outer surface 212 of the inner guide cylinder 205 and the inner surface 214 of the outer cylinder 203. In some implementations, the outer cylinder 203 can include the groove 402 formed in the inner surface 214. The groove 402 can span at least a length of the outer cylinder 203. The groove 402 can have a shape that is substantially similar (e.g., identical) to that of the longitudinal guide 207. For example, to receive the longitudinal guide 207 in the groove 402, the groove 402 can have the same pitch and length as the helical guide 207. In some implementations, the longitudinal guide 402 can be integrally formed with and rigidly positioned within the groove, e.g., by welding, soldering or other permanent positioning techniques. In some implementations, the longitudinal guide 207 can be removably positioned such that the longitudinal guide 207 can be removed from the annulus 210 while allowing the stator 202 to be reused.

Figure 5:
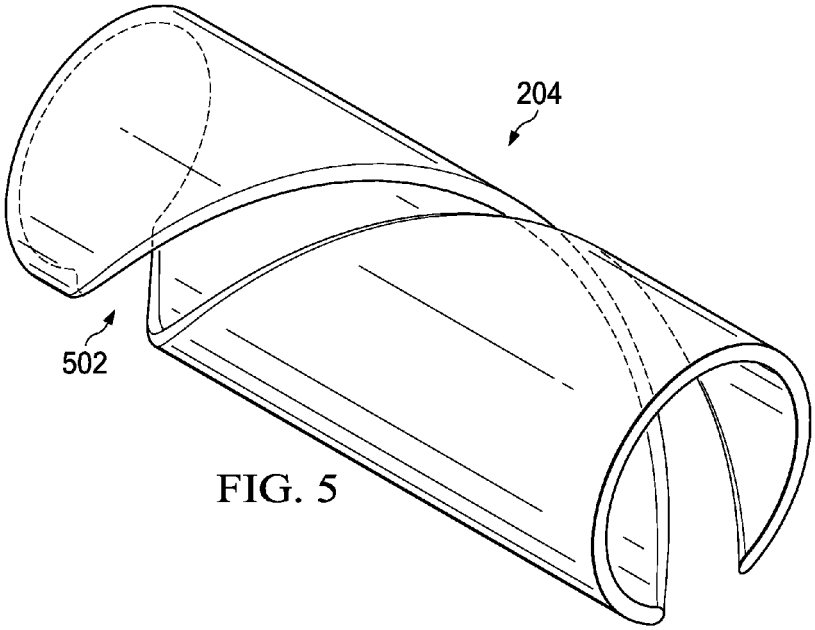
FIG. 5 illustrates an example of a rotor cylinder that nutates on the longitudinal guide of FIG. 3.

FIG. 5 is a perspective view of an example of a rotor cylinder that nutates on the longitudinal guide 207. The device 110 can include a rotor cylinder 204 positioned in the annulus 210 defined by positioning the inner guide cylinder 205 in the longitudinal passage 201 of the outer cylinder 203. In some implementations, the rotor is defined by the rotor cylinder 204 having guide opening 502 positioned through at least a portion of a sidewall of the rotor cylinder. In some implementations, the rotor cylinder 204 can have a cylindrical cross-section and have the guide opening 502 machine cut into the rotor cylinder 202. The guide opening 502 can be formed to correspond to a shape of the longitudinal guide 207 such that the longitudinal guide 207 is received in the guide opening 502. In some implementations, a width of the guide opening 502 can be greater than a width of the longitudinal guide 207. For example, the width of the guide opening 502 can be twice that of a width of the rectangular surface 302. Other widths for the guide opening 502 greater than the width of the rectangular surface 302 and sufficient to decrease (or eliminate) interference between the rotor cylinder 204 and the longitudinal guide 207 during nutation (described below) are also possible.

Figure 2C:
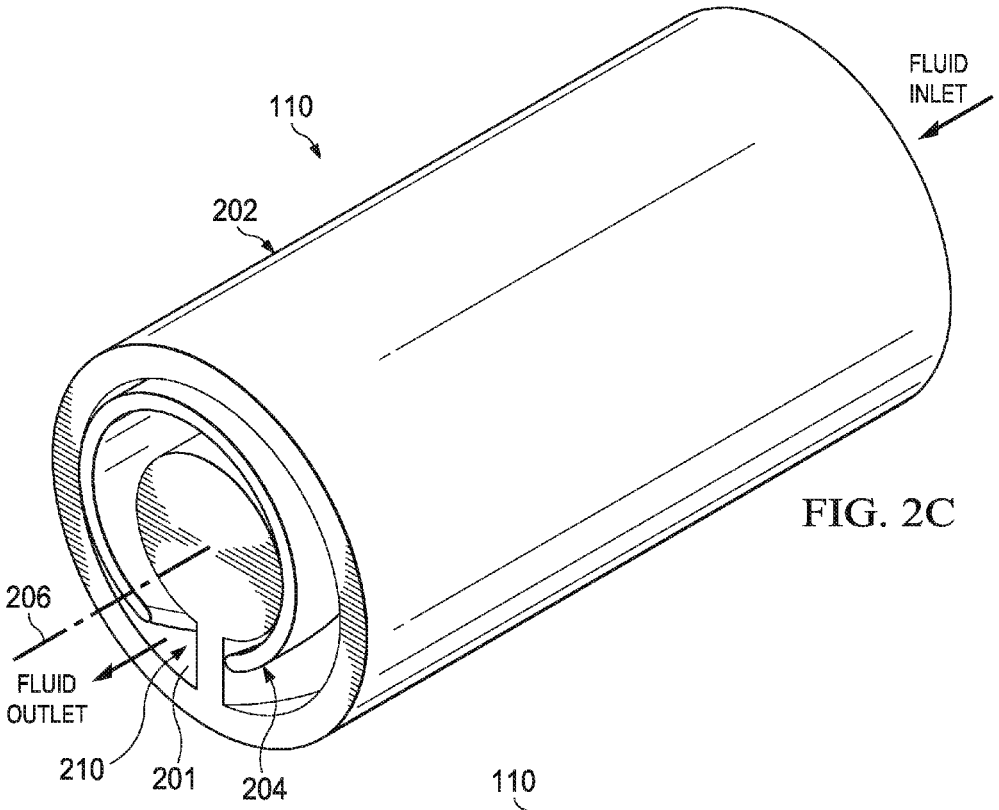
FIG. 2C is a perspective view showing fluid flow through the energy converter of FIG. 2A.
Figure 2D:
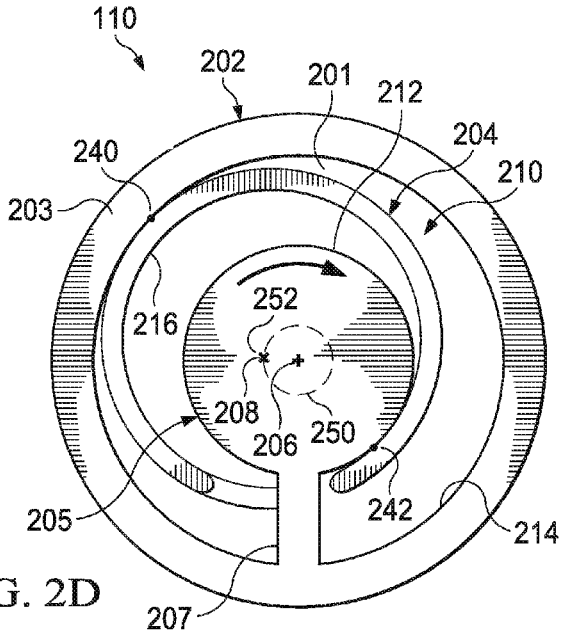
FIG. 2D is a cross-sectional view showing an example rotor cylinder nutating in the energy converter of FIG. 2A.

FIG. 2C is a perspective view showing a direction of fluid flow through the fluid-mechanical device 110. Whereas the outer cylinder 203 and the inner guide cylinder 205 are concentric, as shown in FIG. 2B, the rotor cylinder 204 is eccentric relative to the outer cylinder 203 and the inner guide cylinder 205. For example, an axis of rotation 208 of the rotor cylinder 204 is offset from an axis of rotation 206 of the inner guide cylinder 205 (or the outer cylinder 203) as shown in FIG. 2D. The eccentricity of rotation of the rotor cylinder 204 about the outer cylinder 203 and the inner guide cylinder 205 can be increased by increasing a distance between an inner surface of the outer cylinder 203 and an outer surface of the inner guide cylinder 205. For example, the eccentricity of rotation of the rotor cylinder 204 can be increased by increasing a height of the longitudinal groove 207. This arrangement of the rotor cylinder 204 in the annulus 210 facilitates a nutation of the rotor cylinder 204 in the annulus 210 in response to fluid flow through the annulus.

FIG. 2C illustrates fluid flowing into the annulus 210 at an end of the device 110. The fluid (e.g., water, drilling mud, or other fluid) flows along the longitudinal axis 206 of the outer cylinder 203 (or the inner guide cylinder 205). As the fluid flows through the annulus 210, the fluid contacts the rotor cylinder 204. The positioning of the guide opening 502 of the rotor cylinder 204 on the longitudinal guide 207 causes the rotor cylinder 204 to nutate within the annulus 210.

FIG. 2D is a cross-sectional view showing an example rotor cylinder nutating in the fluid-mechanical device 110. As the rotor cylinder 204 nutates within the annulus 210 in response to fluid flow through the annulus 210, the axis of rotation 208 of the rotor cylinder 204 rotates about the axis of rotation 206 of the outer cylinder 203 (FIG. 2D). At a first time instant ($t_1$), the axis of rotation 208 of the rotor cylinder 204 is at a first point 252 on the circular path 250. At $t_1$, an outer surface of the rotor cylinder 204 contacts the inner surface 214 of the outer cylinder 203 (at position 240), and an inner surface of the rotor cylinder 204 contacts the outer surface 212 of the inner guide cylinder 205 (at position 242). The position 240 is diametrically opposite to the position 242, the diameter being that of the rotor cylinder 204, i.e., passing through the axis of rotation 208 of the rotor cylinder 204.

At a second time instant ($t_2$) subsequent to $t_1$, the axis of rotation 208 of rotor cylinder 204 is at a second point (not shown) on the circular path 250. At $t_2$, the outer surface of the rotor cylinder 204 contacts the inner surface 214 of the outer cylinder 203 at a position that is different from position 240. Simultaneously, at $t_2$, the inner surface of the rotor cylinder 204 contacts the outer surface 212 of the inner guide cylinder 205 at a position that is different from position 242. In this manner, the rotor cylinder 204 is disposed tangentially within the annulus 210. That is, an outer surface and an inner surface of the rotor cylinder 204 continuously contact the inner surface 214 of the outer cylinder 203 and the outer surface 212 of the inner guide cylinder 205, respectively, as the rotor cylinder 204 nutates within the annulus 210. Over time, the axis of rotation 208 of the rotor cylinder 204 defines a substantially circular path 250 around the axis of rotation 206 of the outer cylinder 203. The combined rotation of the rotor cylinder 204 about the axis of rotation 208, and the rotation of the axis of rotation 208 about the axis of rotation 206 of the outer cylinder 203 represents a nutation of the rotor cylinder 204 within the annulus 210.

A direction of rotation of the rotor cylinder 204 within the annulus 210 depends on a direction in which the longitudinal guide 207 is helically wound on the inner guide cylinder 205. If the rotor cylinder 204 rotates in a clockwise direction, then the axis of rotation 208 of the rotor cylinder 204 also rotates on the circular path 250 in the clockwise direction, and vice versa. The guide opening 502 is positioned on the longitudinal groove 207 such that the rotor cylinder 204 receives a torque generated in response to flow of the fluid through the annulus 210, the torque being responsible for the nutation of the rotor cylinder 204 described above. To decrease (or eliminate) wear that can result from the nutation of the rotor cylinder 204, a polymeric material (e.g., an elastomer, a rubber such as nitrile butadiene rubber, or other wear-resistant material such as those used in mud motors) can be disposed on the inner surface 214 of the outer cylinder 203 or the outer surface 212 of the inner guide cylinder 205 or on an outer surface of the longitudinal guide 207 (or combinations of them). Alternatively, or in addition, the polymeric material can be disposed on the outer surface inner surface or the outer surface of the rotor cylinder 204 (or both).

Figure 6:
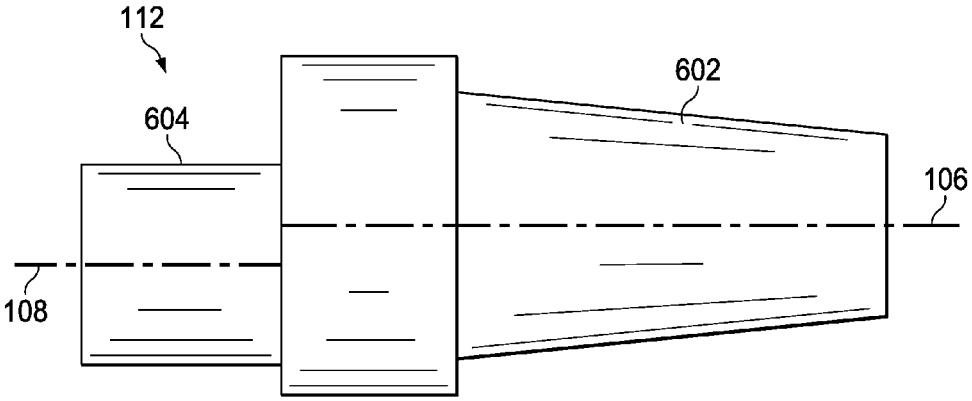
FIG. 6 is a schematic diagram of an example rotation transfer device.

FIG. 6 is a schematic diagram of an example rotation transfer device 112. In some implementations, the rotation transfer device 112 can include a cam member having an input end 604 that can be connected to a rotary output of the rotor cylinder 204 of the fluid-mechanical device 110. The cam member can further include an output end 602 that be connected to a bottom hole assembly that includes the wellbore drill bit 50. The input end 604 of the rotation transfer device 112 has a central longitudinal axis that is coaxial with the central longitudinal axis 108 of the rotor cylinder 204. When the input end 604 of the rotation transfer device 112 is connected to the rotor cylinder 204, e.g., using a bearing connection, and when the rotor cylinder 204 rotates in the annulus 210, as described above, the input end 604 also rotates within the drill string 20. The output end 602 of the rotation transfer device 112 has a central longitudinal axis that is coaxial with the central longitudinal axis 106 of the stator 202. When the input end 604 rotates within the drill string 20, the output end 602 also rotates about the axis 106 of the stator 202. Consequently, a rotation of the output end 602 of the rotation transfer device 112 is coaxial with the longitudinal axis 106 of the stator. By connecting the wellbore drill bit 50 to the output end 602 of the rotation transfer device 112, e.g., using a bearing pack assembly, at least a portion of the rotation of the rotation transfer device 112 can be transferred to the wellbore drill bit 50.

Figure 7A:
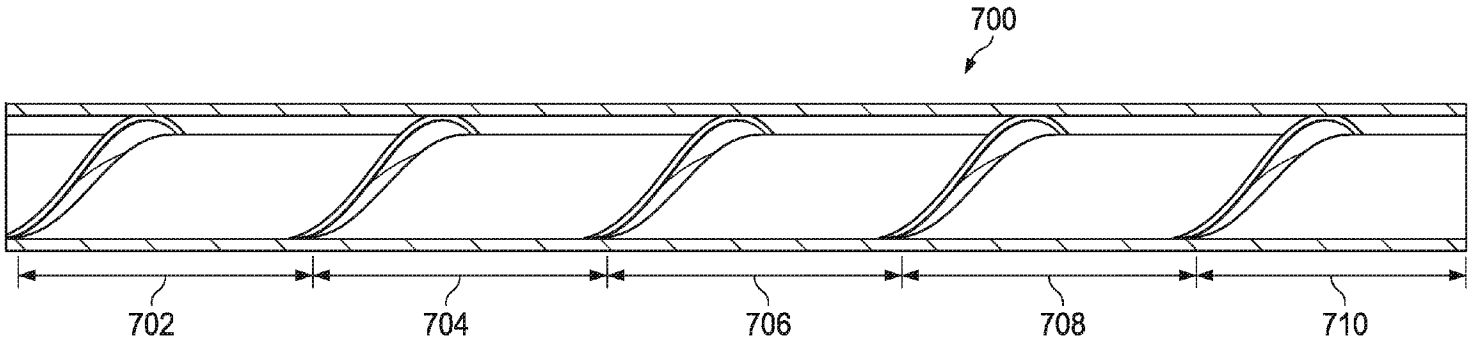
FIG. 7A is a schematic diagram of a front view an example multi-stage nutating fluid-mechanical energy converter included in the power section.
Figure 7B:
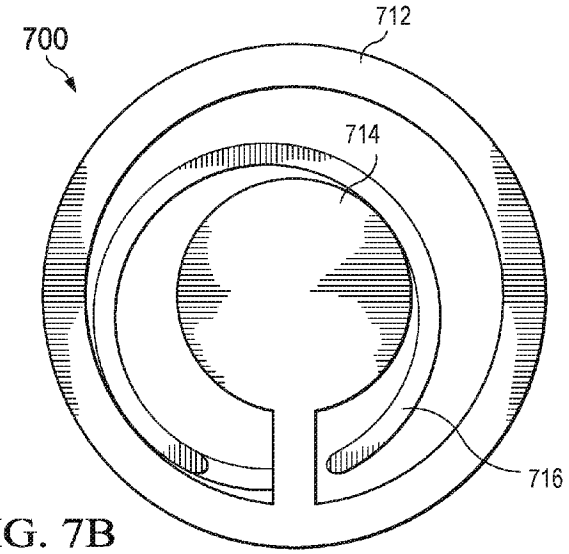
FIG. 7B is a schematic diagram of a side view of the example multi-stage fluid-mechanical energy converter included in the power section.
Figure 8A:
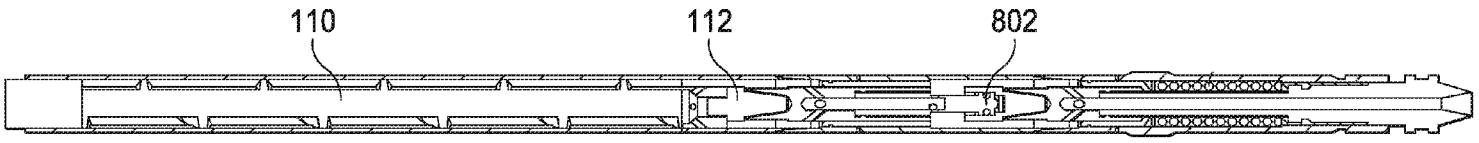
FIG. 8A is a schematic diagram of an example power section used in directional drilling.

In some implementations, the rotation transfer device 112 shown in FIG. 6 can be connected to the fluid-mechanical device 110 shown in FIG. 8A. The arrangement of the stator 202 and the rotor cylinder 204 in the fluid-mechanical device 110 shown in FIG. 2B represents a single stage device. Additional stages can be formed by assembling additional stators and rotors in devices, as described above, and arranging the devices in series. FIG. 7A is a schematic diagram of a front view an example multi-stage nutating fluid-mechanical energy converter 700 included in the power section. FIG. 7B is a schematic diagram of a side view of the example multi-stage fluid-mechanical energy converter 700 included in the power section. The multi-stage converter 700 shown in FIG. 7A represents an implementation including five stages (e.g., a first stage 702, a second stage 704, a third stage 706, a fourth stage 708, a fifth stage 710). The multi-stage converter 700 can be formed as a single, integral device. In addition, an axial length of the device 700 can be increased by increasing a number of helical turns of the longitudinal groove around the inner guide cylinder 714 and by increasing a length of the guide opening in the rotor cylinder 716 positioned in the annulus defined by the stator 712 and the inner guide cylinder 714.

As shown in FIG. 1C, an end of the rotor cylinder 204 of the fluid-mechanical device 110 can be modified to enable a connection of the rotor cylinder with the input end 604 of the rotation transfer device 112, e.g., using bearings. The fluid-mechanical device 110 and the rotation transfer device 112 can be positioned in the drill string 20 to define a wellbore drilling fluid flow path through which the drilling fluid can flow from the surface to the wellbore drill bit 50. The wellbore drilling fluid flow path can include multiple flow channels (e.g., a first slot 114*a*, a second slot 114*b*, a third slot 114*c*) positioned in the end of the rotor cylinder that connects to the input end 604 of the rotation transfer device. Each flow channel can have a first end in fluid contact with the fluid-mechanical device 110 (i.e., the rotor cylinder) and a second end in fluid contact with the rotation transfer device 112. The wellbore drilling fluid can flow from the surface through the wellbore drill string 50, into and through the fluid-mechanical device 110 as described above, and exit the fluid-mechanical device 110 through the multiple flow channels. The wellbore drilling fluid can then flow in an annulus 116 around the cam member of the rotation transfer device 112, and exit the rotation transfer device 112.

In some implementations, the output end 602 of the rotation transfer device 112 can include a threaded connection to connect the rotation transfer device 112 to the wellbore drill bit 50. For example, the output end 602 of the rotation transfer device can include a bearing pack assembly. The wellbore drilling fluid path can include additional flow channels to receive the wellbore drilling fluid that exits the rotation transfer device 112. Each flow channel can include a first end in fluid contact with the rotation transfer device 112 (e.g., the output end 602), and a second end in fluid contact with the wellbore drill bit 50. The flow channels can divert the wellbore drilling fluid that exits the rotation transfer device 112 into the wellbore drill string 20 causing the wellbore drilling fluid to flow toward the wellbore drill bit 50.

Figure 8B:
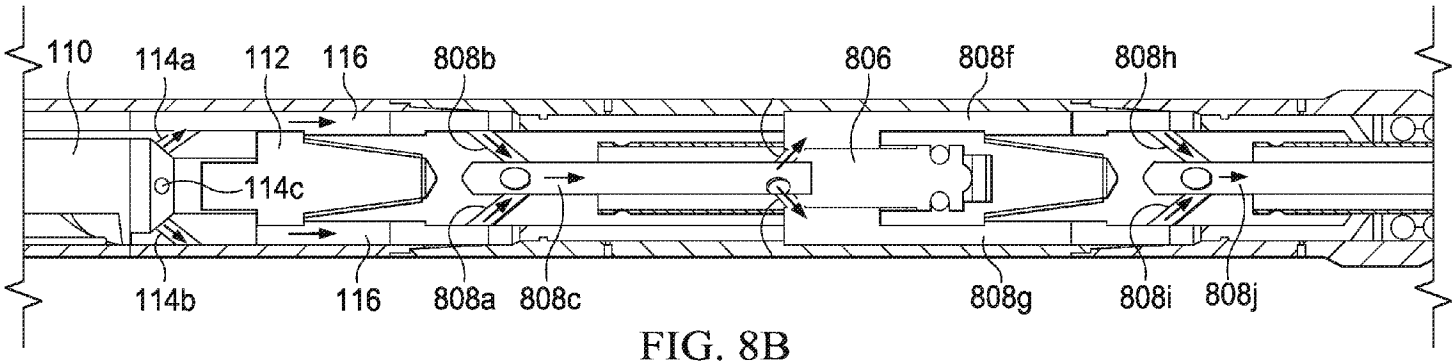
FIG. 8B is a schematic diagram of an example power section used in directional drilling.
Figure 8C:
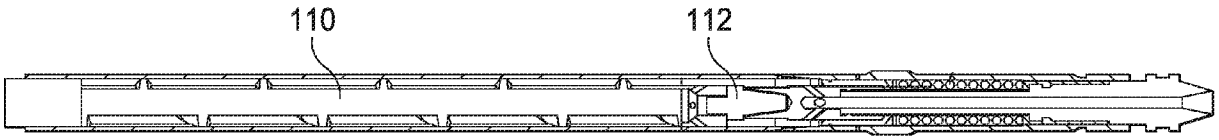
FIG. 8C is a schematic diagram of an example power section used in straight drilling.

Each of FIG. 8A and FIG. 8B is a schematic diagram of an example power section used in directional drilling. The rotation transfer device 112 connected to the fluid-mechanical device 110 operates in a manner similar to a constant velocity shaft of a conventional mud motor. The rotation transfer device 112 converts the nutation of the rotor 204 into rotation, which can be transferred to the wellbore drill bit 50. The wellbore drilling system shown in FIGS. 8A and 8B can include additional constant velocity shafts (e.g., the shaft 802) and a bent housing to drill the wellbore at desired angles. The bent housing can have a fixed bent angle or an adjustable bent angle. The constant velocity joint can compensate the angle of the bent housing and transfer the same amount of torque at that angle. FIG. 8C is a schematic diagram of an example power section used in straight drilling, which includes the fluid-mechanical device 110, the rotation transfer device 112, and a bearing pack assembly.

The arrows in FIG. 8B show the flow path of the wellbore drilling fluid. As described above, the wellbore drilling fluid flows through and exits the fluid-mechanical device 110 through multiple flow channels (e.g., slots 114*a*, 114*b*, 114*c*). The wellbore drilling fluid flows through the annulus 116 defined between the wellbore drill string 20 and the rotation transfer device 112. The wellbore drilling fluid re-enters the drill string through multiple flow channels (e.g., slot 808*a*, slot 808*b*) and flows toward the constant velocity joint 806 through the flow channel 808*c*. The wellbore drilling fluid enters another annulus defined by the flow channels 808*f* and 808*g* to flow through the bent housing. The wellbore drilling fluid again re-enters the drill string through the flow channels 808*h*, 808*j*, and 808*i*, and flows through the bearing pack assembly towards the wellbore drill bit 50. The number of flow channels shown in the figures is exemplary; more or fewer flow channels can be implemented to flow the wellbore drilling fluid.

Figure 9:
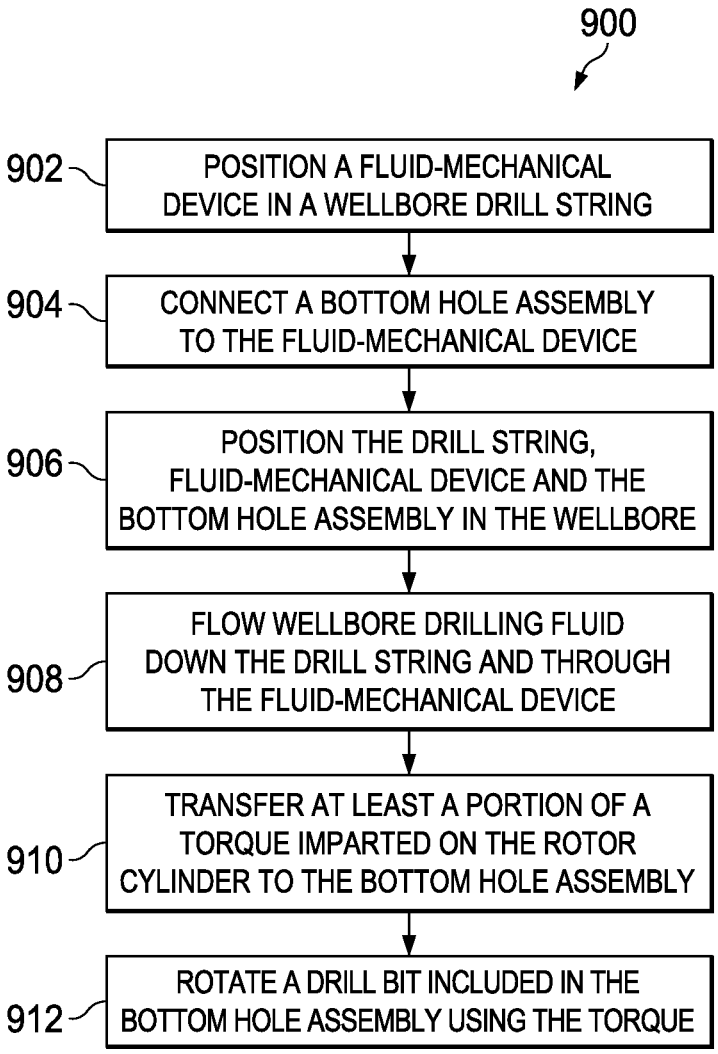
FIG. 9 is a flowchart of an example process for powering a wellbore drilling system.

FIG. 9 is a flowchart of an example process 900 for powering a wellbore drilling system. At 902, the fluid-mechanical device described above is positioned in a wellbore drill string. At 904, a bottom hole assembly that includes the wellbore drill bit 50 is connected to an output of the rotor cylinder of the fluid-mechanical device. At 906, the drill string, the fluid-mechanical device and the bottom hole assembly are positioned in the wellbore. At 908, wellbore drilling fluid is flowed down the drill string and through the fluid-mechanical device. A torque is imparted on the rotor cylinder in response to the wellbore drilling fluid flowing through the fluid-mechanical device. At 910, at least a portion of the torque is transferred to the bottom hole assembly including the drill bit. At 912, the drill bit is rotated with at least a portion of the torque. The rotation of the drill bit is used to drill the wellbore in the formation.

The torque imparted to the rotor cylinder 204 includes two components—a pressure component and a viscous component. Above a threshold flow rate, the viscous component is insignificant relative to the pressure component. The resultant of the pressure exerts a net torque on the rotor cylinder 204. A computational model of the wellbore drilling system 100 including the fluid-mechanical device 110 and the rotational transfer device 112 was developed. The performance of such a power section was compared to that of a conventional mud motor. The table below shows a pressure drop versus torque for the power section that was 11 inches long and included a single stage.

| Torque (ft · lbf) | Pressure drop (psi) |
|---|---|
| 117 | 11.9 |
| 176 | 16.9 |
| 259 | 24.5 |
| 326 | 30.4 |

-continued

| Torque (ft · lbf) | Pressure drop (psi) |
|---|---|
| 397 | 36.7 |
| 468 | 43.0 |
| 539 | 49.3 |
| 610 | 55.6 |
| 681 | 61.9 |
| 752 | 68.2 |
| 823 | 74.5 |
| 894 | 80.8 |

The table below shows pressure drop versus torque for a conventional mud motor having a size of 11¼, 3:4 lobes, and 3.6 stages.

| Torque (ft · lbf) | Pressure drop (psi) |
|---|---|
| 1800 | 75 |
| 4000 | 150 |
| 6200 | 225 |
| 8400 | 300 |
| 10600 | 375 |

A plot of torque v/s pressure drop for the computational model of the power section and the conventional mud motor reveals that both lines have the same slope indicating that the motor performances are comparable. With increase in the number of stages in the wellbore drilling system 100, the torque output can increase. The torque output and speed can be varied by varying the eccentricity of rotor cylinder positioned in the annulus defined by the outer cylinder and the inner guide cylinder of the stator. Thus, the wellbore drilling system 100 can be implemented to achieve a higher torque output relative to a conventional mud motor.

In general, one innovative aspect of the subject matter described here can be implemented as a wellbore drilling system that includes a fluid-mechanical device and a rotation transfer device, each positionable in a wellbore drill string. The fluid-mechanical device includes a stator including an outer cylinder having a longitudinal passage. The fluid-mechanical device includes a longitudinal guide positioned in the longitudinal passage. The stator and the longitudinal guide define an annulus. The longitudinal guide spans at least a portion of a length of the stator. The fluid-mechanical device includes a rotor cylinder positioned in the annulus. The rotor cylinder has a sidewall with a guide opening to receive the longitudinal guide. The rotor cylinder is rotatable within the stator along the longitudinal guide in response to the wellbore drilling fluid flow through the annulus. The rotation transfer device is connected to the fluid-mechanical device to transfer at least a portion of a rotation of the rotor cylinder to a wellbore drill bit.

This, and other aspects, can include one or more of the following features. The rotation transfer device can include a cam member having an input end connectable to a rotary output of the rotor cylinder, and an output end connectable to a bottom hole assembly including the wellbore drill bit. The input end of the cam member can have a central longitudinal axis coaxial with a central longitudinal axis of the rotor cylinder. The output end of the cam member can have a central longitudinal axis coaxial with a central longitudinal axis of the stator. The axis of the input end can be offset from the axis of the output end. A rotational output of the rotation transfer device can be coaxial with the longitudinal axis of the stator. A wellbore drilling fluid flow path can include multiple flow channels positioned in an end of the rotor cylinder that connects to the input end of the rotation transfer device. Each flow channel can have a first end in fluid contact with the fluid-mechanical device and a second end in fluid contact with the rotation transfer device. The wellbore drilling fluid flowed through the wellbore drill string can flow into and through the fluid-mechanical device, exit the fluid-mechanical device through the multiple flow channels, flow in an annulus around the cam member, and exit the rotation transfer device. The input end of the rotation transfer device can include a bearing connection to connect to an end of the rotor cylinder. The output end of the rotation transfer device can include a threaded connection to connect to the wellbore drill bit. The output end of the rotation transfer device can further include a bearing pack assembly. The rotor cylinder can define a first stage of the fluid-mechanical device. The fluid-mechanical device can further include multiple serially connected stages, each including a respective rotor cylinder positioned in the annulus. The stator can further include an inner guide cylinder disposed longitudinally within the outer cylinder. The inner guide cylinder and the outer cylinder can define the annulus for wellbore drilling fluid flow. The longitudinal guide can be positioned inside at least a portion of the outer cylinder. The longitudinal guide can be attached to a portion of an outer surface of the inner guide cylinder and extend outwardly toward an inner surface of the outer cylinder. The rotor cylinder can include a sidewall with the guide opening that receives the longitudinal guide. The outer cylinder and the inner guide cylinder can be concentric, and the rotor cylinder can be eccentric relative to the outer cylinder and the inner guide cylinder. The longitudinal guide can include a helical guide spanning at least a portion of the length of the inner guide cylinder. A width of the guide opening can be greater than a width of the longitudinal guide. The longitudinal guide can connect the outer surface of the inner guide cylinder and the inner surface of the outer cylinder. The outer cylinder can include a groove formed in the inner surface of the outer cylinder to receive the longitudinal guide. The groove can span at least a length of the outer cylinder. An outer surface of the rotor cylinder can continuously contact an inner surface of the outer cylinder as the rotor cylinder nutates in response to flow of the fluid through the annulus. An inner surface of the rotor cylinder can continuously contact an outer surface of the inner guide cylinder as the rotor cylinder nutates in response to flow of the fluid through the annulus. The wellbore drilling system can further include a polymeric material disposed on an inner surface of the outer cylinder and an outer surface of the longitudinal guide. The guide opening can be positioned on the longitudinal groove such that the rotor cylinder can receive a torque generated in response to flow of the fluid through the annulus.

Another innovative aspect of the subject matter described here can be implemented as a wellbore drilling system that includes a fluid-mechanical device and a rotation transfer device, each positionable in a wellbore drill string. The fluid-mechanical device includes an outer cylinder having a longitudinal passage. An inner guide cylinder is disposed longitudinally within the outer cylinder. The inner guide cylinder and the outer cylinder define an annulus for wellbore drilling fluid flow. A longitudinal guide is positioned inside at least a portion of the outer cylinder. The longitudinal guide is attached to a portion of an outer surface of the inner guide cylinder and extends outwardly toward an inner surface of the outer cylinder. A rotor cylinder including a sidewall with a guide opening receives the longitudinal guide. The rotation transfer device is connected to the fluid-mechanical device and transfers at least a portion of a rotation of the rotor cylinder to a wellbore drill bit.

This, and other aspects, can include one or more of the following features. The wellbore drilling system can include a wellbore drilling fluid flow path including multiple first flow channels. Each first flow channel can be positioned in an end of the rotor cylinder that connects to an input end of the rotation transfer device. Each first flow channel can have a first end in fluid contact with the fluid-mechanical device and a second end in fluid contact with the rotation transfer device. The wellbore drilling fluid flowed through the wellbore drill string can flow into and through the fluid-mechanical device, and exit the fluid-mechanical device through the multiple first flow channels, flow in an annulus around the rotation transfer device, and exit the rotation transfer device. The wellbore drilling fluid flow path can include multiple second flow channels. Each second flow channel can be positioned in an output end of the rotation transfer device. Each second flow channel can have a first end in fluid contact with the rotation transfer device and a second end in fluid contact with the wellbore drill bit. The wellbore drilling fluid that exits the rotation transfer device can flow into and through the multiple second flow channels toward the wellbore drill bit.

A further innovative aspect of the subject matter described here can be implemented as a method for rotating a drill bit of a wellbore drilling system. A fluid-mechanical device is positioned in a wellbore drill string. The fluid-mechanical device includes an inner guide cylinder in an outer guide cylinder having a longitudinal passage to define an annulus for wellbore drilling fluid flow. The inner guide cylinder and the outer guide cylinder are concentric. A longitudinal guide is positioned inside at least a portion of the outer cylinder. The longitudinal guide is attached to a portion of an outer surface of the inner guide cylinder and extends outwardly toward an inner surface of the outer cylinder. The fluid-mechanical device includes a rotor cylinder in the annulus to be eccentric relative to the inner guide cylinder and the outer cylinder. The rotor cylinder includes a guide opening positioned through at least a portion of a sidewall of the rotor cylinder. The guide opening is received on the longitudinal guide. A bottom hole assembly including a drill bit is connected to an output of the rotor cylinder. The drill string, the fluid-mechanical device and the bottom hole assembly are positioned in a wellbore. Wellbore drilling fluid is flowed down the drill string and through the fluid-mechanical device. A torque is imparted on the rotor cylinder in response to the wellbore drilling fluid flowing through the fluid-mechanical device. At least a portion of the torque is transferred to the bottom hole assembly including the drill bit. The drill bit is rotated with at least a portion of the torque.

This, and other aspects, can include one or more of the following features. Transferring at least the portion of the torque can include providing a rotation transfer device including a cam member. The cam member can have an input end connectable to a rotary output of the rotor cylinder, and an output end connectable to a bottom hole assembly including the wellbore drill bit. The input end of the rotation transfer device can be connected to an end of the rotor cylinder. The input end can have a first axis. The output end of the rotation transfer device can be connected to the bottom hole assembly. The output end can have a second axis. The first axis of the input end can be coaxial with an axis of the rotor cylinder. The second axis of the output end can be coaxial with an axis of the outer cylinder. Transferring at least the portion of the torque to the bottom hole assembly can include converting rotation of the rotor cylinder about the first axis to a rotation of the output end of the rotation transfer device about the second axis.

A number of implementations have been described. Nevertheless, it will be understood that various modifications may be made without departing from the spirit and scope of the disclosure.

The invention claimed is:

1. A wellbore drilling system comprising:

a fluid-mechanical device positionable in a wellbore drill string, the fluid-mechanical device comprising:

a stator including an outer cylinder having a longitudinal passage;

a longitudinal guide positioned in the longitudinal passage, the longitudinal guide spanning at least a portion of a length of the stator; and a rotor cylinder positioned in the longitudinal passage between the stator and the longitudinal guide, the rotor cylinder having a sidewall with a guide opening to receive the longitudinal guide, the rotor cylinder rotatable within the stator along the longitudinal guide in response to a wellbore drilling fluid flow through the longitudinal passage; and a rotation transfer device positionable in the wellbore drill string and connected to the fluid-mechanical device, the rotation transfer device to transfer at least a portion of a rotation of the rotor cylinder to a wellbore drill bit.

2. The system of claim 1, wherein the rotation transfer device comprises a cam member having:

an input end connectable to a rotary output of the rotor cylinder; and an output end connectable to a bottom hole assembly including the wellbore drill bit.

3. The system of claim 2, wherein the input end of the cam member has a central longitudinal axis coaxial with a central longitudinal axis of the rotor cylinder and the output end of the cam member has a central longitudinal axis coaxial with a central longitudinal axis of the stator, wherein the axis of the input end is offset from the axis of the output end, whereby a rotational output of the rotation transfer device is coaxial with the longitudinal axis of the stator.

4. The system of claim 2, further comprising a wellbore drilling fluid flow path including a plurality of flow channels positioned in an end of the rotor cylinder that connects to the input end of the rotation transfer device, each flow channel having a first end in fluid contact with the fluid-mechanical device and a second end in fluid contact with the rotation transfer device, wherein the wellbore drilling fluid flowed through the wellbore drill string flows into and through the fluid-mechanical device and exits the fluid-mechanical device through the plurality of flow channels, flows in an annulus around the cam member, and exits the rotation transfer device.

5. The system of claim 2, wherein the input end of the rotation transfer device comprises a bearing connection to connect to an end of the rotor cylinder, and wherein the output end of the rotation transfer device comprises a threaded connection to connect to the wellbore drill bit.

6. The system of claim 5, wherein the output end of the rotation transfer device further comprises a bearing pack assembly.

7. The system of claim 1, wherein the rotor cylinder defines a first stage of the fluid-mechanical device, and wherein the fluid-mechanical device further comprises a plurality of serially connected stages, each stage comprising a respective rotor cylinder positioned in a respective space.

8. The system of claim 1, wherein the stator further comprises an inner guide cylinder disposed longitudinally within the outer cylinder, the inner guide cylinder and the outer cylinder defining an annulus for the wellbore drilling fluid flow, wherein the longitudinal guide is positioned inside at least a portion of the outer cylinder, the longitudinal guide attached to a portion of an outer surface of the inner guide cylinder and extending outwardly toward an inner surface of the outer cylinder.

9. The system of claim 8, wherein the outer cylinder and the inner guide cylinder are concentric, and the rotor cylinder is eccentric relative to the outer cylinder and the inner guide cylinder.

10. The system of claim 8, wherein the longitudinal guide comprises a helical guide spanning at least a portion of the length of the inner guide cylinder, and wherein a width of a guide opening is greater than a width of the longitudinal guide.

11. The system of claim 8, wherein the longitudinal guide connects the outer surface of the inner guide cylinder and the inner surface of the outer cylinder, and wherein the outer cylinder includes a groove formed in the inner surface of the outer cylinder to receive the longitudinal guide, the groove spanning at least a length of the outer cylinder.

12. The system of claim 8, wherein an outer surface of the rotor cylinder continuously contacts an inner surface of the outer cylinder as the rotor cylinder nutates in response to flow of the wellbore drilling fluid through the annulus, and wherein an inner surface of the rotor cylinder continuously contacts an outer surface of the inner guide cylinder as the rotor cylinder nutates in response to flow of the fluid through the annulus.

13. The system of claim 8, further comprising a polymeric material disposed on an inner surface of the outer cylinder and on an outer surface of the longitudinal guide.

14. The system of claim 11, wherein a guide opening is positioned on the longitudinal groove such that the rotor cylinder receives a torque generated in response to flow of the wellbore drilling fluid through the space.

15. A wellbore drilling system comprising:

a fluid-mechanical device positionable in a wellbore drill string, the fluid-mechanical device comprising:

an outer cylinder having a longitudinal passage;

an inner guide cylinder disposed longitudinally within the outer cylinder, the inner guide cylinder and the outer cylinder defining an annulus for wellbore drilling fluid flow;

a longitudinal guide positioned inside at least a portion of the outer cylinder, the longitudinal guide attached to a portion of an outer surface of the inner guide cylinder and extending outwardly toward an inner surface of the outer cylinder;

a rotor cylinder including a sidewall with a guide opening to receive the longitudinal guide; and a rotation transfer device positionable in the wellbore drill string and connected to the fluid-mechanical device, the rotation transfer device to transfer at least a portion of a rotation of the rotor cylinder to a wellbore drill bit.

16. The system of claim 15, further comprising a wellbore drilling fluid flow path including a plurality of first flow channels, each first flow channel positioned in an end of the rotor cylinder that connects to an input end of the rotation transfer device, each first flow channel having a first end in fluid contact with the fluid-mechanical device and a second end in fluid contact with the rotation transfer device, wherein the wellbore drilling fluid flowed through the wellbore drill string flows into and through the fluid-mechanical device, and exits the fluid-mechanical device through the plurality of first flow channels, flows in an annulus around the rotation transfer device and exits the rotation transfer device.

17. The system of claim 16, wherein the wellbore drilling fluid flow path includes a plurality of second flow channels, each second flow channel positioned in an output end of the rotation transfer device, each second flow channel having a first end in fluid contact with the rotation transfer device and a second end in fluid contact with the wellbore drill bit, wherein the wellbore drilling fluid that exits the rotation transfer device flows into and through the plurality of second flow channels toward the wellbore drill bit.

18. A method for rotating a drill bit of a wellbore drilling system, the method comprising:

positioning a fluid-mechanical device in a wellbore drill string wherein said fluid-mechanical device includes:

an inner guide cylinder in an outer guide cylinder having a longitudinal passage to define an annulus for wellbore drilling fluid flow, wherein the inner guide cylinder and the outer guide cylinder are concentric, and wherein a longitudinal guide is positioned inside at least a portion of the outer cylinder, the longitudinal guide attached to a portion of an outer surface of the inner guide cylinder and extending outwardly toward an inner surface of the outer cylinder; and a rotor cylinder in the annulus to be eccentric relative to the inner guide cylinder and the outer cylinder, the rotor cylinder comprising a guide opening positioned through at least a portion of a sidewall of the rotor cylinder, the guide opening to be received on the longitudinal guide;

connecting a bottom hole assembly including a drill bit to an output of the rotor cylinder;

positioning the drill string, the fluid-mechanical device and the bottom hole assembly in a wellbore;

flowing wellbore drilling fluid down the drill string and through the fluid-mechanical device, wherein a torque is imparted on the rotor cylinder in response to the wellbore drilling fluid flowing through the fluid-mechanical device;

transferring at least a portion of the torque to the bottom hole assembly including the drill bit; and rotating the drill bit with at least a portion of the torque.

19. The method of claim 18, wherein transferring at least the portion of the torque comprises:

providing a rotation transfer device including a cam member having:

an input end connectable to a rotary output of the rotor; and an output end connectable to a bottom hole assembly including the wellbore drill bit;

connecting the input end of the rotation transfer device to an end of the rotor cylinder, the input end having a first axis; and connecting the output end of the rotation transfer device to the bottom hole assembly, the output end having a second axis.

20. The method of claim 19, wherein the first axis of the input end is coaxial with an axis of the rotor cylinder, wherein the second axis of the output end is coaxial with an axis of the outer cylinder, and wherein transferring at least the portion of the torque to the bottom hole assembly comprises converting a rotation of the rotor cylinder about the first axis to a rotation of the output end of the rotation transfer device about the second axis.

* * * * *